US007033414B2

(12) United States Patent
Barchese

(10) Patent No.: US 7,033,414 B2
(45) Date of Patent: Apr. 25, 2006

(54) METHOD OF PRODUCING TABLETS FORMED BY PREALLOYS OF ALUMINUM-IRON PRODUCED FROM AUTOMIZED POWDERS, AND TABLETS PRODUCED THEREBY

(76) Inventor: Ivan Calia Barchese, Rua Poaca, 159 -Jardim Yambere Diadema, Estado de Sao Paulo 09970-300 (BR)

( * ) Notice: Subject to any disclaimer, the term of this patent is extended or adjusted under 35 U.S.C. 154(b) by 0 days.

(21) Appl. No.: 10/349,445

(22) Filed: Jan. 22, 2003

(65) Prior Publication Data

US 2003/0147767 A1 Aug. 7, 2003

(30) Foreign Application Priority Data

Jan. 22, 2002 (BR) ..... 02000152

(51) Int. Cl.
*B22F 9/08* (2006.01)

(52) U.S. Cl. ..... 75/338

(58) Field of Classification Search ..... 75/333, 75/338

See application file for complete search history.

(56) References Cited

U.S. PATENT DOCUMENTS 3,614,000 A * 10/1971 Blythe ..... 241/5
4,171,275 A 10/1979 Merrill et al.
5,090,997 A * 2/1992 Birkenstock et al. ..... 75/338
6,383,248 B1 * 5/2002 Taylor et al. ..... 75/247

FOREIGN PATENT DOCUMENTS

JP 11/92893 A * 4/1999

OTHER PUBLICATIONS

ASM Handbook, vol. 7, Powder Metal Technologies and Applications, 1998, ASM International, p. 42.*
Standard Test Procedure for Measuring the Dissolution of Aluminum Hardeners, The Alluminum Association, 1990, pp. 1-11.
Lee, Young et al: "Dissolution Mechanism for High Melting Point Transition Elements in Aluminum Melt." Light Metals 2000, TMS, 2000.
Metals Handbook 8th Edition. vol. 8, p. 262.

* cited by examiner

*Primary Examiner*—George Wyszomierski
(74) *Attorney, Agent, or Firm*—Michael J. Striker

(57) ABSTRACT

A tablet formed by prealloys iron-aluminum produced from atomized powders to be used as additive element in aluminum alloys, is manufactured by the method having the steps of obtaining a metallic alloy by fusion of iron and aluminum with the iron and aluminum added in an electric arc or induction furnace, atomizing the melted alloy by transporting the melted alloy to an intermediary container with an opening as a metal flux controlled by a valve located in the opening for controlling and proportionating a continuous flux and supplying a jet of water under pressure when the liquid metal drains to provide atomization and to produce small droplets that cool in water, solidify and are deposited as a powder; reducing humidity of the powder; classifying the thusly produced material, and compacting a thin fraction of the material for obtaining tablets; a tablet.

6 Claims, 1 Drawing Sheet

| | |
|---|---|
| Cost of iron powder (90% M.P) | 1180 |
| Cost of aluminum powder (10% M.P) | 520.8 |
| Cost of manufacture by powder mixing | 340 |
| Total cost with the use of the mixing process | 2040.8 |

| | |
|---|---|
| Cost of iron scrap (90% M.P) | 225 |
| Cost of aluminum scrap (10% M.P) | 347 |
| Cost of manufacture by automization | 550 |
| Total cost with the use of automization process | 1152 |

| | |
|---|---|
| Cost reduction | 43% |

TABLE

| | |
|---|---|
| Cost of iron powder (90% M.P) | 1180 |
| Cost of aluminum powder (10% M.P) | 520.8 |
| Cost of manufacture by powder mixing | 340 |
| Total cost with the use of the mixing process | 2040.8 |
| | |
| Cost of iron scrap (90% M.P) | 225 |
| Cost of aluminum scrap (10% M.P) | 347 |
| Cost of manufacture by automization | 550 |
| Total cost with the use of automization process | 1152 |
| | |
| Cost reduction | 43% |

Figure 1

METHOD OF PRODUCING TABLETS FORMED BY PREALLOYS OF ALUMINUM-IRON PRODUCED FROM AUTOMIZED POWDERS, AND TABLETS PRODUCED THEREBY

BACKGROUND OF THE INVENTION

The present invention relates to a tablet of aluminum-iron obtained by automization of powders, with the use of water and similar substances, so that such tablet can be used as an alloy element for aluminum.

The invention also relates to a method of producing tablets formed by aluminum-iron alloys which contains preferably 90% of iron and 10% of aluminum, by metallurgical fusion process and subsequent automization of metals with water jets and the like.

The tablet is originated from iron aluminum powder of 90%–10% following compaction, to be utilized as an alloy element for industry.

One of the most widely used forms of addition of alloy elements to metallic baths of aluminum are elements which contain an alloy, mainly in the form of tablets or briquettes. In commercial processes the aluminum powders are mixed to powders of the alloy elements to be added, such as iron, chrome, titanium, copper, manganese, nickel, etc. This mixture is subjected to shaping by pressing, that basically defines the density and resistance to green. In addition to this physical characteristics, the tablets shall have also a good performance with regard to dissolution of the alloy element. In other words, they should have a good yield and an adequate chemical composition in accordance with specific standards of customers.

Companies around the world produce some types of tablets with the use of elementary powder mixtures. It has been noted that the maximum limit of the alloy element remains around 75–85%. If on the one hand a customer purchasing the tablet is willing the tablet to be formed only by the alloy element, on the other hand there is no need for using the aluminum powder in order to guarantee a minium of compressibility and resistance to the green. Besides, it seems that there is a relationship between the aluminum quantity in the tablet and the dissolution of the alloy element as disclosed for example in a paper presented to the Congress of Aluminum Brazilian Association in 2000 in which the results of studies are presented with respect to the MnAl tablets and their dissolution in aluminum baths.

Several sources are known which disclose manufacture of tablets of the alloy elements. These sources include U.S. Pat. No. 4,171,275, an aluminum rule of the Aluminum Association and a recently published article by the Minerals, Metals and Materials Society. A patent issued in 1979 describes the manufacture of briquets of AL—Mn produced by compacting of mixtures containing 77% in manganese mass.

SUMMARY OF THE INVENTION

Accordingly, it is an object of the present invention to provide a method of manufacturing tablets with alloy elements from preallied powders, as well as to tablets produced by the method, which are further improvements of the existing methods and tablets.

The tablets produced by a mixing process of aluminum and iron have a higher cost, as shown in the table presented in FIG. 1, which presents a comparison of the existing process with mixtures of powders, with a new process including automization of metallic alloys.

In addition to the lower cost, the tablets produced in accordance from the present invention with preallied powders have higher efficiency or yield in an aluminum bath when compared with the tablets produced by the mixing process.

From the point of view of utilization of the tablets, the dissolution time of the tablets produced from preallied powders is shorter than that of mixed powders and therefore efficiency of the alloy elements is increased and waiting time in the liquid metal bath is reduced.

The commercial iron and aluminum metallic powders available in the marketplace have special characteristics and must satisfy very strict quality requirements of manufacturers of synthesized products (referring to iron powder) or of pigment manufactures and the aluminum-thermic industry in the case of aluminum powder. Because of this, the conventional powders have a relatively high cost.

As shown in Table 1 the automization of prealloy leads to an important reduction in the final price of the powders, once the basic raw material to be used can be based on steel and aluminum scrap, with substantially lower quality restrictions (lower elaboration cost) and a more adequate granulometry for manufacture of the tablets. Another important advantage is verticalization and incorporation of the margins of the manufacturers of powders in the final price of the product.

The novel features which are considered as characteristic for the present invention are set forth in particular in the appended claims. The invention itself, however, both as to its construction and its method of operation, together with additional objects and advantages thereof, will be best understood from the following description of specific embodiments.

BRIEF DESCRIPTION OF THE DRAWINGS

The single FIGURE of the drawings is a table showing the comparison between a conventional method and a method in accordance with the present invention.

DESCRIPTION OF THE PREFERRED EMBODIMENTS

In accordance with the present invention, in a first stage (1) of the manufacturing method a metallic alloy is obtained by melting of two metals, in particular iron and aluminum. These metals are added around an electric furnace arc or in induction furnace in forms of scraps in the preferred proportion of 90% of iron and 10% of aluminum. The temperature of the bath in this phase reaches 1750° C. The liquid metal can be treated as a fluxing element to decrease oxidation of metals and therefore to increase the efficiency of melting.

In the following stage (2) which involves automization, the melted alloy is transported to an intermediate padle (container) with an opening in its lower end. The liquid metal flux is controlled by a valve located in the opening, to control and proportionate the continuous flux. The liquid metal when drained from the lower end receives a water jet under pressure, causing automization and production of small droplets that cool very fast in water, solidify and are deposited in the bottom of the tank of automization in form of powder. The system can be protected by an inert gas for reducing powder oxidation. In the automization process the water has a significant technical and economical impact in production of steel of low and high contents of alloys. The process is however restricted to the production of alloys that do not have an excessive oxidation harming the quality of the automized powder. The water pressure in the process varies from $65\times10^5$ Pa to $210\times10^5$ Pa, associated with the water speed of 70 m/s to 230 m/s. The air and its congenors can be used in this stage for obtaining similar results.

After the automization in the stage (3) the obtained powder shall have a reduced humidity. For this purpose it is bombed to a centrifuge machine or a hydrocyclone, and thereafter to a vacuum filter.

In next stage (4) the humidity of the material is totally eliminated with the use of a dryer.

In stage (5) the material is classified in a vibrating screen. The thick material returns to the furnace and the fine material is compacted for obtaining of tablets.

The final stages include, respectively, compacting and packaging stage (6) and a remittance stage (7).

The iron and aluminum percentages in the pre-mixture vary in a wide range, for example as follows:

| Iron | Aluminum |
|---|---|
| 75% | 25% |
| 50% | 50% |
| 60% | 40% |
| 80% | 20% |
| 85% | 15% |

The percentages of the elements can be inverted. However the commercially preferable range is 90% of iron and 20% of aluminum.

The tablet produced by the inventive method has a three-dimensional shape. It is formed by a product in the preallied cylindrical form of iron and aluminum, with preferably 90% of iron and 10% of aluminum. In other words it is a metallic alloy in powder and not "a mixture of powders". In this alloy the above mentioned elements are automized powders. The tablet is used as an alloy element for increasing the hardness of aluminum parts.

The prealloyed tablets of iron 90% iron and 10% aluminum can be used in aluminum industry in remelting stage, where the metal is treated and adapted for elaboration of aluminum alloys.

It will be understood that each of the elements described above, or two or more together, may also find a useful application in other types of methods and tablets differing from the types described above.

While the invention has been illustrated and described as embodied in method of producing tablets formed by prealloys of aluminum-iron produced from automized powders, and tablets produced thereby, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for producing a tablet formed by atomized prealloy of iron-aluminum powder to be used as aluminum hardener in aluminum bath, the method comprising the steps of obtaining a metallic alloy by melting solid 90% iron and 10% aluminum scraps in an induction furnace; atomizing the melted alloy by transporting the alloy to an intermediate container with an opening for controlling and proportionating a continuous flux and supplying a jet of water under pressure to provide atomization and to produce small droplets that cool in water, solidify and are deposited as a powder; drying the powder; classifying the thusly produced powder and compacting the powder within a range between minimum 70% bigger than 100-mesh and 0.5% maximum bigger than 35-mesh for obtaining tablets containing 90% iron and 10% aluminum; packaging the tablets in a form useful for dissolving in aluminum bath in an industrial process.

2. A method as defined in claim 1, wherein said drying the powder is performed in an equipment selected from the group consisting of a centrifuge machine and hydrocyclone with subsequently transporting the powder to a vacuum filter, and finally eliminating water content by a dryer.

3. A method as defined in claim 1, wherein said classifying Includes classifying the powder in a vibrating screen.

4. A method as defined in claim 1; and further compilsing providing a temperature of the melted iron and aluminum to reach 1750° C.

5. A method for producing a tablet formed by atomized prealloy of iron-aluminum powder to be used as aluminum hardener in aluminum bath, the method comprising the steps of obtaining a metallic alloy by melting solid 90% iron and 10% aluminum scraps in an induction furnace; atomizing the melted alloy by transporting the alloy to an intermediate container with an opening for controlling and proportionating a continuous flux and supplying a jet of water under pressure to provide atomization and to produce small droplets that cool in water, solidify and are deposited as a powder; drying the powder; classifying the thusly produced powder and compacting the powder within a range between minimum 70% bigger than 100-mesh and 0.5% maximum bigger than 35-mesh for obtaining tablets containing 90% iron and 10% aluminum; packaging the tablets in a form useful for dissolving in aluminum bath in an industrial process, wherein said drying includes drying in a centrihuge machine or a hydro cyclone, with subsequent transportation of the material to a vacuum filter, and final drying by a dryer.

6. A method for producing a tablet formed by atomized prealloy of iron-aluminum powder to be used as aluminum hardener in aluminum bath, the method comprising the steps of obtaining a metallic alloy by melting solid 90% iron and 10% aluminum scraps in an induct on furnace; atomizing the melted alloy by transporting the alloy to an intermediate container with an opening for controlling and proportionating a continuous flux and supplying a jet of water under pressure to provide atomization and to produce small droplets that cool in water, solidify and are deposited as a powder; drying the powder; classifying the thusly produced powder and compacting the powder within a range between minimum 70% bigger than 100-mesh and 0.5% maximum bigger than 35-mesh for obtaining tablets containing 90% iron and 10% aluminum; packaging the tablets in a form useful for dissolving in aluminum bath in an industrial process; and providing a temperature of the melted alloy to reach 1750° C.

* * * * *